US007640908B2

(12) United States Patent
Wessels

(10) Patent No.: US 7,640,908 B2
(45) Date of Patent: Jan. 5, 2010

(54) FLUID DISTRIBUTION MANIFOLD

(76) Inventor: Stephen Wessels, 1 Doclan St, Nambour, Queensland 4560 (AU)

( * ) Notice: Subject to any disclaimer, the term of this patent is extended or adjusted under 35 U.S.C. 154(b) by 0 days.

(21) Appl. No.: 11/628,143

(22) PCT Filed: May 30, 2005

(86) PCT No.: PCT/AU2005/000744

§ 371 (c)(1),
(2), (4) Date: Nov. 29, 2006

(87) PCT Pub. No.: WO2005/119044

PCT Pub. Date: Dec. 15, 2005

(65) Prior Publication Data

US 2008/0011258 A1 Jan. 17, 2008

(30) Foreign Application Priority Data

Jun. 1, 2004 (AU) ..... 2004902878

(51) Int. Cl.
*F02M 35/10* (2006.01)

(52) U.S. Cl. ..... 123/184.53; 123/184.21

(58) Field of Classification Search .....
123/184.28–184.33, 184.38–184.41, 184.53, 123/184.56, 184.21
See application file for complete search history.

(56) References Cited

U.S. PATENT DOCUMENTS 1,458,481 A * 6/1923 Good ..... 123/184.39
2,730,339 A * 1/1956 Presnell ..... 123/184.32
3,024,774 A * 3/1962 Eby, Jr. ..... 123/184.53
5,074,258 A * 12/1991 Hitomi et al. ..... 123/184.38

FOREIGN PATENT DOCUMENTS

| | | | |
|---|---|---|---|
| DE | 3728179 | | 8/1987 |
| DE | 3728179 | A1 * | 3/1989 |
| DE | 4202531 | | 12/1992 |
| JP | 01-208511 | | 8/1989 |
| JP | 02291470 | A * | 12/1990 |
| JP | 04-136420 | | 5/1992 |

OTHER PUBLICATIONS

Derwent 96-114017/12, Jan. 16, 1996, Aisin.

* cited by examiner

*Primary Examiner*—Noah Kamen
(74) *Attorney, Agent, or Firm*—Defillo & Associates, Inc.; Evelyn A. Defillo

(57) ABSTRACT

An intake manifold (1) is disclosed suitable for use with an internal combustion engine. The manifold (1) comprises a set of runners (1,2,3,4), a conical-shaped chamber (7) and a conical-shaped distribution body (8) affixed concentrically within the chamber (7). The chamber (7) has one end (9) affixed to an air intake/throttle body. The other end (10) of the chamber (7) is connected to each of the runners (1,2,3,4) such that the end (10) is evenly divided into four quadrants each quadrant being of the same cross-sectional area. The order of connection of the runners (1,2,3,4) to the end (10) is in the firing order of the cylinders 1 3 4 2. The volume of each runner (1,2,3,4) is identical. The respective ends of the runners (1,2,3,4) immediately adjacent the end (10) of the chamber are curved towards the inlet valve of the respective cylinders they serve. The internal conical distribution body (8) is affixed within the chamber (7) such that its broader end (11) evenly overlaps the runners (1,2,3,4) at their junction with the end (10) and is positioned at, or closely to, that end (10). The body (8) may be movable axially within the chamber (7).

11 Claims, 3 Drawing Sheets

FLUID DISTRIBUTION MANIFOLD

CROSS REFERENCE TO RELATED APPLICATION

This application is a national stage of PCT/AU2005/000744 filed May 30, 2005 and based upon Australian Application No. AU2004902878 filed Jun. 1, 2004, under the International Convention.

FIELD OF THE INVENTION

This invention relates to fluid distribution, In particular, the present invention is directed to the flow of gaseous fluid into or out of an internal combustion engine, especially but not limited to, the intake of air and/or air/fuel mixtures into one or more cylinders of such, an engine. Although specific reference will be made to the intake manifold of an internal combustion engine for illustrative purposes, it will be understood that this invention could be used in other applications whereby a flow of fluid, particularly gaseous fluid, is divided evenly into multiple flows.

BACKGROUND OF THE INVENTION

An internal combustion engine employs an inlet manifold to distribute an air/fuel mixture into the cylinders of the engine. The mixture is drawn into the combustion chambers of the engine by a vacuum created therein by piston movement during the downward "induction" stroke of each cylinder. The induction of air/fuel mixtures into an internal combustion engine is a complicated phenomenon, one problem being to provide uniform air/fuel mixtures to each cylinder under all operating conditions.

There have been many attempts to resolve this particular problem. One method has been to employ a separate independent manifold to each cylinder. However, such an arrangement is often restricted to race engines as the cost of manufacture is significant for everyday road cars. For many everyday road cars, a single plane manifold thus remains in use serving all cylinders or, in some cases, a two-plane manifold is used, each manifold serving only half of the total number of cylinders. These types of manifolds exhibit a tendency for one cylinder to "rob" the air/fuel mixture from another cylinder.

Further, the design of an intake manifold can effect the torque and power outputs of a particular engine. Torque is required low down in the engine speed while power is required in the upper end. In the prior art solutions, designing a manifold which provides low down torque sacrifices high end power and vice versa. In an attempt to resolve these opposing requirements, some modern vehicles now incorporate an intake manifold whose configuration "changes" according to the operating conditions of the engine. These are often referred to as dual-length or variable intake manifolds. Once again, however, such designs are relatively costly to manufacture.

SUMMARY OF THE INVENTION

It is thus a general object of the present invention to overcome, or at feast ameliorate, one or more of the above-mentioned disadvantages.

According to a first aspect of the present invention, there is provided a manifold for the even distribution of a fluid to a multiple of runners, said manifold including:

a chamber to receive said fluid;

said multiple of runners operatively connected to said chamber to receive said even distribution of said fluid; and distribution means within said chamber adapted to divide said fluid evenly to each of said multiple of runners.

Preferably, the total cross-sectional area of said multiple of runners is substantially equal to the cross-sectional area of said chamber at the interface of said chamber with said multiple of runners.

Preferably, each of said multiple of runners is of a substantially identical cross-sectional area at the respective interface of each of said multiple of runners with said chamber.

Preferably, each of said multiple of runners is of a substantially identical length.

Preferably, each of said multiple of runners depends at a substantially identical angle from said chamber.

When the present invention is used as a manifold for an internal combustion engine, preferably, said multiple of runners depend from their respective interface with said chamber sequentially in the directions toward the associated intake valve in the firing order of that engine.

Preferably, said distribution means is positioned substantially concentrically within said chamber.

Preferably, said distribution means is a tapered body.

Preferably, said tapered body has its larger end overlapping a substantially equal portion of each of said multiple of runners at said respective interface.

For an intake manifold used on an internal combustion engine, when the piston in a cylinder descends, it creates a low pressure in the combustion chamber that causes a negative wave to travel along the Intake port and manifold runner. When the wave reaches the plenum chamber, it is reflected back towards the engine. This returning wave has the potential to help ram more air into the combustion chamber provided it reaches the intake valve when it is open again. Designing an intake system for this pulse tuning is a desired outcome for most car engineers, particularly for race cars.

As an optional feature of the present invention, said distribution means can be further adapted to include a movement means to enable said distribution means to be moved preferably axially within said chamber thus providing a means to alter the timing of the return of said negative wave to the intake valve.

In those embodiments of the present invention which include a said movement means, said movement means can be moved mechanically or activated electrically or be vacuum operated.

Further, for an intake manifold used on an internal combustion engine in a motor vehicle, it is known that space constraints may restrict the geometry of the intake system, most usually requiring sharp bends within the intake system, leading to turbulent flow of the incoming air and/or air/fuel mixture which, in turn, leads to an uneven distribution thereof to the combustion chambers. This turbulent flow is caused by separation of the boundary layer of the fluid at the internal surfaces of the plenum chamber. This turbulent flow can be reduced if the internal surfaces are not smooth.

Therefore, as an optional feature of the present invention, depending on the geometry required, the outer surface of said distribution means can have a substantially non-smooth surface, Similarly, as a further optional feature of the present invention, the internal surface of said chamber can have a substantially non-smooth surface.

A suitable said non-smooth surface includes rough cast, dimples, grooves or ridges-For an intake manifold used on an internal combustion engine, it is known that power and torque outputs for any particular engine can depend on the runner length, runner diameter and plenum chamber volume which are dependent on valve size, port size and required rpm range, As will be appreciated, the manifold of the present invention remains equally adapted to enable these parameters to be determined for each particular engine and thus the necessary cross-sectional area of the runners can be determined.

Further optional features of the present invention include (a) a heating means for said distribution means and/or said chamber to assist vaporization of an air/fuel mixture therein; (b) a cooling means for said distribution means and/or said chamber to enable a denser charge of air/fuel mixture to enter the combustion chambers; and (c) for V- or flat-configuration engines or where an engine is twin turbo- or super-charged or a combination thereof, dual of said manifold can be used, each manifold serving alternate cylinders in firing order.

Components of the present invention can be manufactured from any suitable materials known in the art including metal (such as steel and aluminum), plastics and carbon fibre; their suitability being determined by the temperature and/or pressure to which the components are to be subjected in use.

As a second aspect of the present invention, there is provided a method for the even distribution of a fluid to a multiple of runners, said method including the use of a manifold as hereinbefore described.

Although the present invention finds particular use as an inlet manifold for the internal combustion engine found in motor vehicles it will be appreciated that the principles of its operation can equally be applied for use as an exhaust manifold where it Is required to extract waste gases as evenly and efficiently as possible from a series of adjacent exhaust headers.

BRIEF DESCRIPTION OF THE DRAWINGS

A preferred embodiment of the present invention will now be described with reference to the accompanying drawings, wherein.

DESCRIPTION OF THE INVENTION

Figure 1:
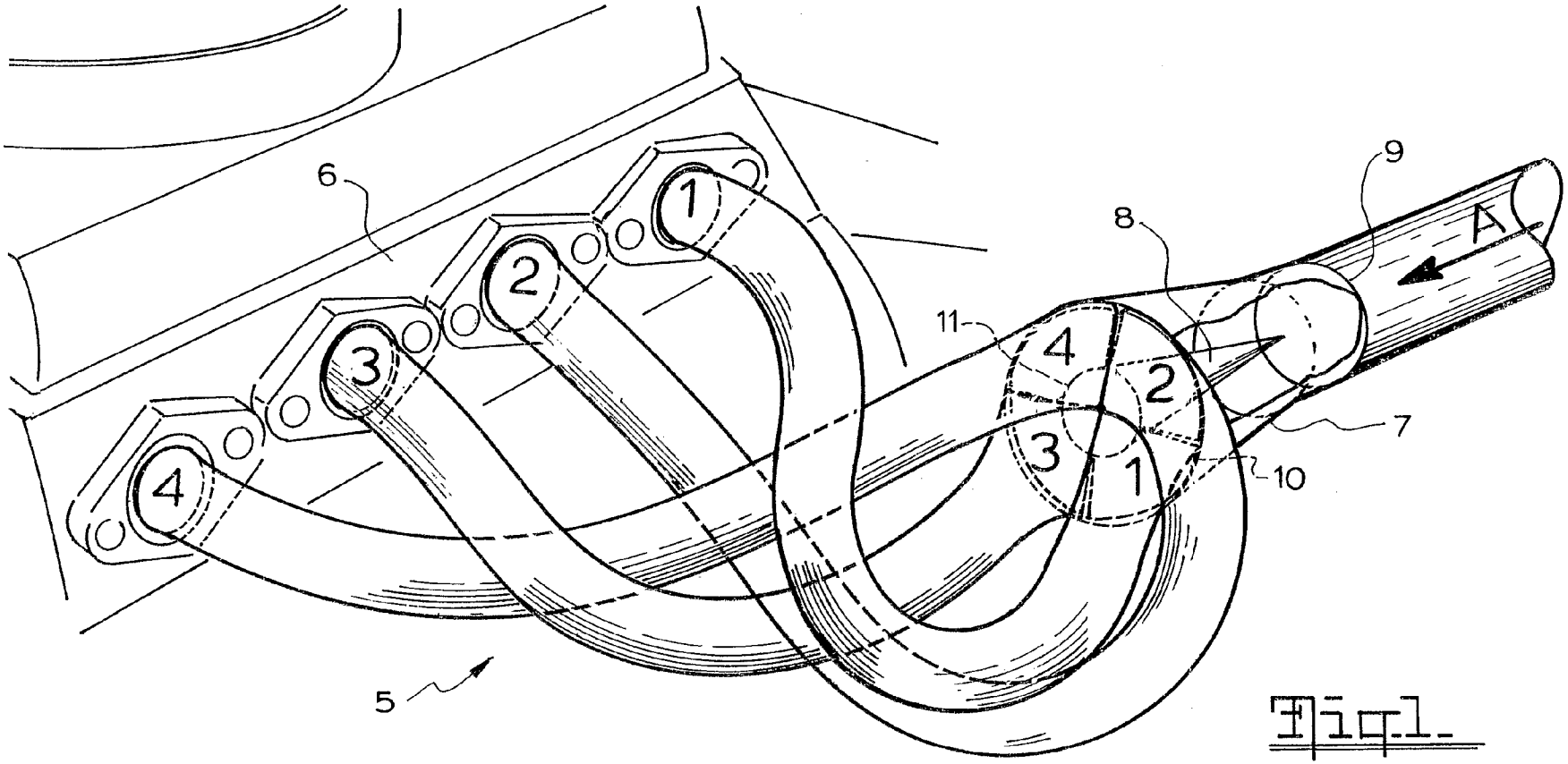
FIG. 1 is a schematic perspective view of a manifold constructed in accordance with the present invention attached to the cylinder head of an internal combustion engine.

Referring to FIG. 1, the manifold (5) is attached to the inlet side of a cylinder head (6) of a four cylinder internal combustion engine having a firing order of 1 3 4 2. The manifold (1) comprises a set of runners (1,2,3,4), a chamber (7) and a conical-shaped body (8) affixed concentrically within the chamber (7). The chamber (7) is of substantially conical configuration with an outer surface. that essentially parallels that of the internal conical body (8), except that an extension of one end (9) thereof is adapted to lead to, or be directly affixed to, an air intake/throttle body. The circular in cross-section other end (10) of the chamber (7) is connected to each of the runners (1,2,3,4) such that the end (10) is essentially evenly divided into four quadrants each quadrant being of substantial the same cross-sectional area. The order of connection of the runners (1,2,3,4) to the end (10) is in the firing order of the cylinders 1 3 4 2, The volume of each runner (1,2,3,4) is substantially identical. The respective ends of the runners (1,2,3,4) immediately adjacent the end (10) of the chamber are curved towards the inlet valve of the respective cylinders they serve. The internal conical body (8) is affixed within the chamber (7) such that its broader end (11) evenly overlaps the runners (1,2,3,4) at their junction with the end (10) and is positioned at, or closely to, that end (10).

In use, an air/fuel mixture enters the chamber (7) from the direction A where it passes over the conical body (8) to be split into essentially four equal streams, each stream then passing into the respective runner (1,2,3,4) as the respective inlet valve of the engine opens. As the runners (1,2,3,4) are connected to the chamber (7) in the firing order of the engine, each stream assists its adjacent stream to overcome initial inertia as the next inlet valve opens, thus leading to a smooth, essentially constant and even flow of air/fuel mixture to each combustion chamber.

Manifolds of the type described above with reference to FIG. 1 have been fitted to a number of vehicles including: (a) 4 cylinder twin cam engine of a Toyota Corolla, (b) 6 cylinder engine of a Ford Falcon, fueled by LPG; and (c) V8 Cleveland engine of a Ford Falcon.

Figure 2:
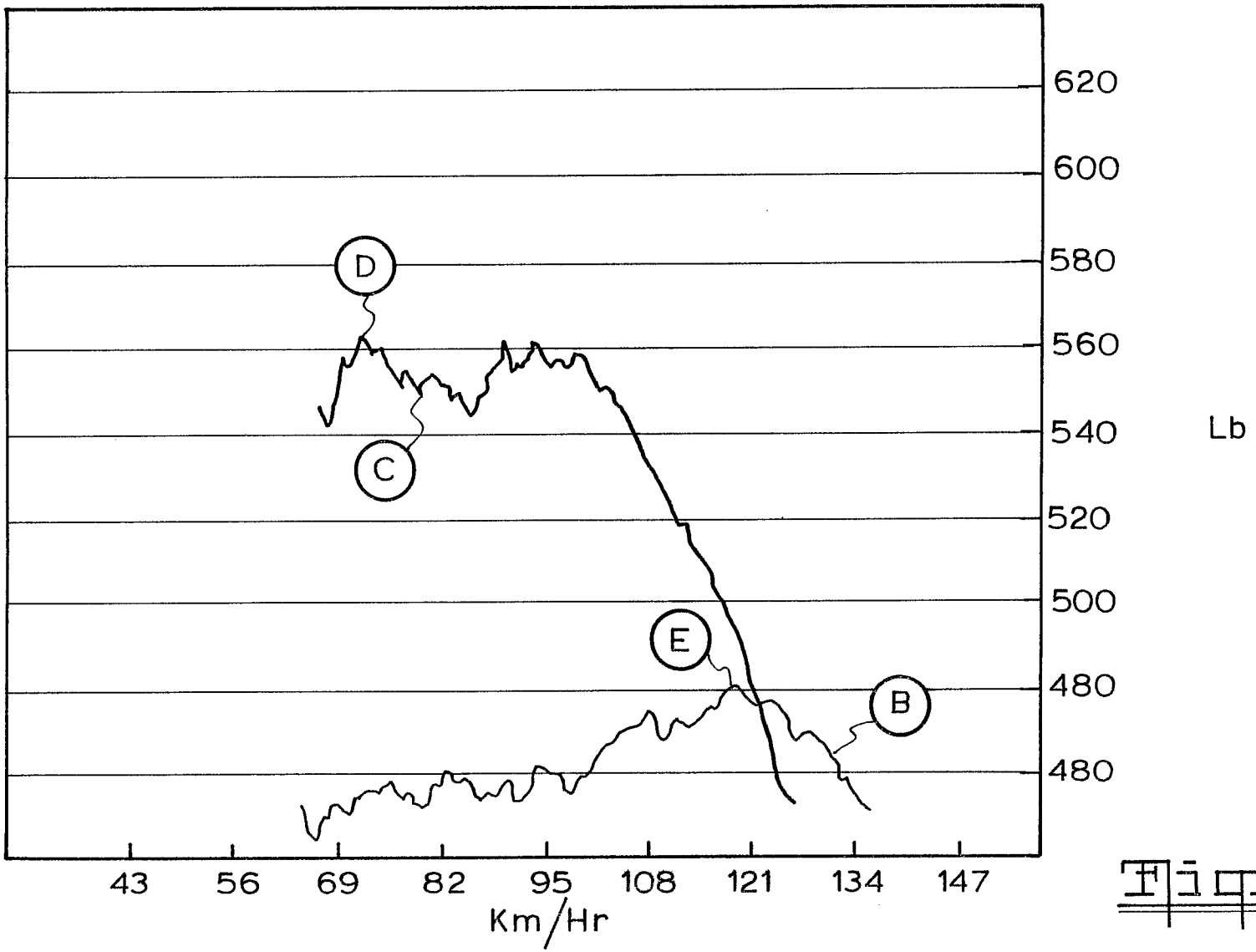
FIG. 2 is a dynamometer graphical printout of torque values of an engine with and without a manifold of the present invention fitted.

FIG. 2 illustrates the torque output (3rd gear) of a 6 cylinder Ford Falcon engine with factory inlet manifold (line B) and after fitted with a manifold of the present invention (line C). Maximum torque when fitted with the manifold of the present invention (point D) is greater, and occurs at a lower engine speed, than the factory manifold (point E). It should be noted that the readings for line D were taken at a higher engine temperature than the readings for line E and the required temperature compensation has not been undertaken. Hence, the actual difference between the torque figures is greater in practice than suggested by FIG. 2.

Figure 3:
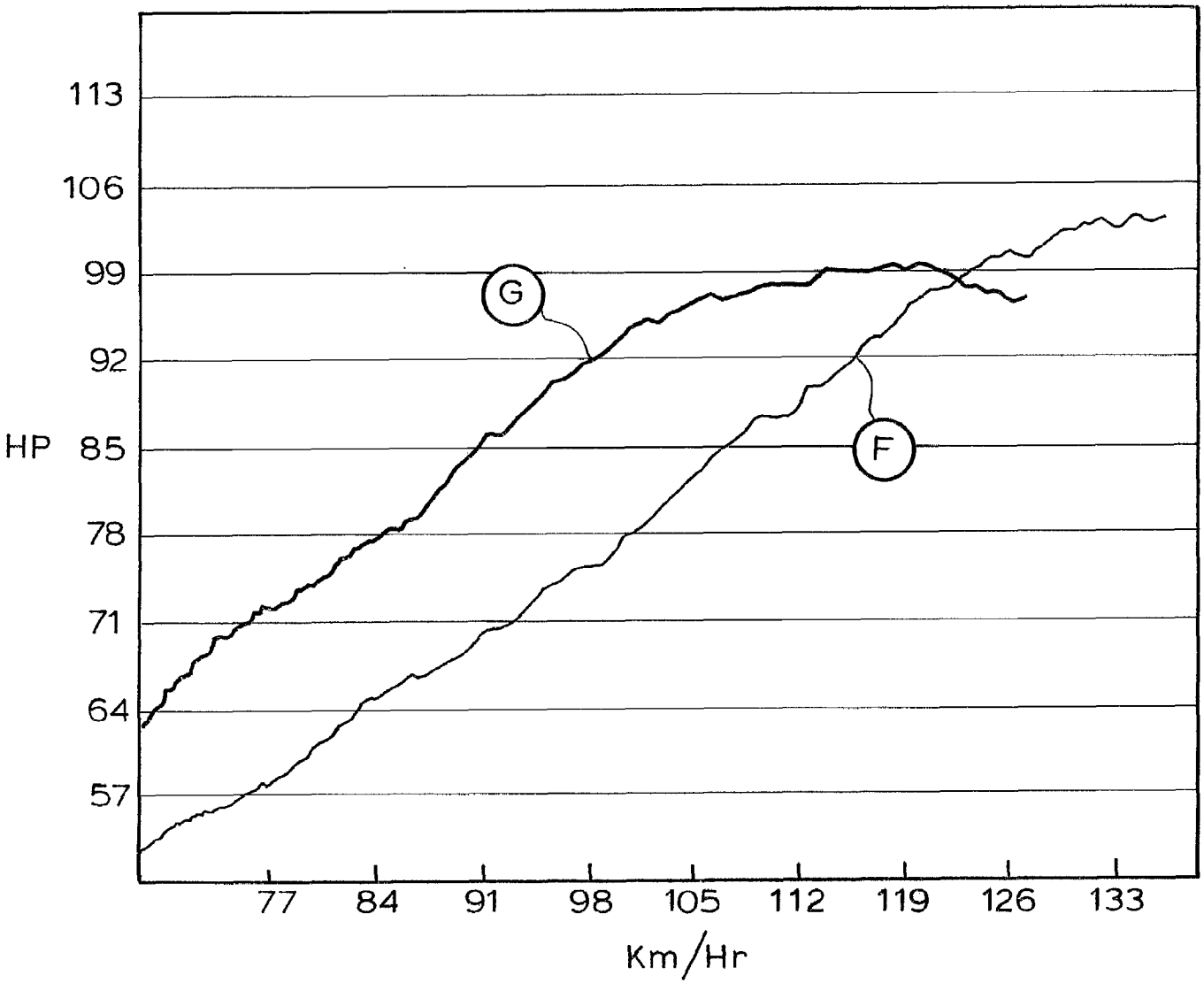
FIG. 3 is a dynamometer graphical printout of horsepower values of an engine with and without a manifold of the present invention fitted.

FIG. 3 illustrates the power output (3rd gear) of the 6 cylinder Ford Falcon engine of FIG. 2 with factory Inlet manifold (line F) and after fitted with a manifold of the present invention (line G). A significant increase in power for any given engine speed throughout road speeds is apparent when compared to that vehicle not fitted with a manifold of the present invention. It should be noted that the readings for line G were taken at a higher engine temperature than the readings for line F and the required temperature compensation has not been undertaken. Hence, the actual difference between the power figures is greater in practice than suggested by FIG. 3.

In all fitments, the vehicles exhibited (i) a significant increase in flexibility, each vehicle readily pulling away from a walking pace while in 3rd gear; (ii) for a given hill of given gradient, each vehicle climbed that 'gradient at a comfortable rate in at least one gear higher when compared to that vehicle not fitted with a manifold of the present invention; (iii) maximum torque was increased, and produced at a lower engine speed when compared to that vehicle not fitted with a manifold of the present invention; and (iv) there was an increase in power for any given engine speed when compared to that vehicle not fitted with a manifold of the present invention.

When used as an inlet manifold for an internal combustion engine in a motor vehicle, the present invention offers a number of advantages, including:

overcoming initial inertia of incoming air/fuel mixture as an inlet valve opens, enables an equal distribution of air/fuel mixture to each combustion chamber;

enables tuning of the negative wave as an inlet valve opens to assist more air/fuel mixture to enter that valve on its next opening;

as the air/fuel mixture is more even and constant, the fuel injectors can be placed closer to the combustion chambers as less fuel is lost from the air/fuel suspension as it flows through the manifold, thus allowing smaller injectors to be used, therefore representing a saving in manufacturing cost; alternatively, additional fuel injectors can be used further from the combustion chambers for increased power at higher engine speeds;

because of the improved air/fuel flow, a superior signal can be generated for recognition by engine management systems which has particular benefit for engines powered solely by gasous fluids such as LPG whereupon such powered engines are easier to start;

an increase in flexibility, leading to fewer gear changes and/or more economical gearing;

increase in maximum torque at a lower engine speed; and an increase in power for any given engine speed.

It will be appreciated that the above described embodiments are only exemplification of the various aspects of the present invention and that modifications and alterations can be made thereto without departing from the inventive concept as defined in the following claims.

The invention claimed is:

1. A manifold for the even distribution of a fluid to a multiple of runners, said manifold including:

a chamber to receive said fluid;

wherein said multiple of runners are operatively connected to said chamber to receive said even distribution of said fluid; and a non-rotating distribution means within said chamber adapted to divide said fluid evenly to each of said multiple of runners, said non-rotating distribution means having a tapered body, its larger end overlapping a substantially equal portion of each of said multiple runners at the interface of said chamber with said multiple of runners, wherein each of said multiple runners is of substantially identical cross-sectional area at the respective interface of each of said multiple of runners with said chamber.

2. The manifold as defined in claim 1, wherein each of said multiple of runners is of substantially identical length.

3. The manifold as defined in claim 1, each of said multiple of runners depends at substantially identical angle from said chamber.

4. The manifold as defined in claim 1, when used in an internal combustion engine, wherein said multiple of runners depend from their respective interface with said chamber sequentially in the direction towards the associated intake valve in the firing order of said engine.

5. The manifold as defined in claim 1, wherein said distribution means is positioned substantially concentrically within said chamber.

6. An internal combustion engine which includes at least one manifold as is defined in claim 1.

7. The manifold as defined in claim 1, wherein the outer surface of the non-rotating distribution means has a non-smooth surface.

8. The manifold as defined in claim 7, wherein the non-smooth surface is chosen from rough cast, dimples, grooves, and ridges.

9. The manifold as defined in claim 1, wherein the internal surface of the chamber has a non-smooth surface.

10. The manifold as defined in claim 9, wherein the non-smooth surface is chosen from rough cast, dimples, grooves, and ridges.

11. A manifold for the even distribution of a fluid to a multiple of runners, said manifold including:

a chamber to receive said fluid;

wherein said multiple of runners are operatively connected to said chamber to receive said even distribution of said fluid; and a non-rotating distribution means within said chamber adapted to divide said fluid evenly to each of said multiple of runners, said non-rotating distribution means having a tapered body, its larger end overlapping a substantially equal portion of each of said multiple runners at the interface of said chamber with said multiple of runners, wherein each of said multiple runners is of substantially identical cross-sectional area at the respective interface of each of said multiple of runners with said chamber;

The manifold as defined in claim 1 wherein the total cross-sectional area of said multiple of runners is substantially equal to the cross-sectional area of said chamber at the interface of said chamber with said multiple of runners.

* * * * *